US006033171A

United States Patent [19]

Doyle et al.

[11] Patent Number: 6,033,171

[45] Date of Patent: Mar. 7, 2000

[54] APPARATUS AND METHOD FOR CUTTING AND CRIMPING A SPIRAL COIL

[75] Inventors: Thomas J. Doyle, Winneconne; Gerald E. Blaha, Neenah, both of Wis.

[73] Assignee: Spiraflex, L.L.C., Greenville, Wis.

[21] Appl. No.: 09/138,262

[22] Filed: Aug. 21, 1998

[51] Int. Cl.[7] ..... B42B 5/10

[52] U.S. Cl. ..... 412/39; 412/1

[58] Field of Search ..... 412/33, 34, 38, 412/39, 40, 42; 140/92.4, 105, 106, 139, 140, 147

[56] References Cited

U.S. PATENT DOCUMENTS

| | | | |
|---|---|---|---|
| 4,161,196 | 7/1979 | Fabrig | 412/39 X |
| 5,785,479 | 7/1998 | Battisti et al. | 412/39 |
| 5,931,623 | 8/1999 | Hastings et al. | 412/39 |

*Primary Examiner*—Willmon Fridie, Jr.

*Attorney, Agent, or Firm*—Andrus, Sceales, Starke & Sawall

[57] ABSTRACT

An automatic cutting and crimping apparatus for a spiral coil binding a book of sheets includes a pair of trim heads slidably attached to a slide bar mounted on a trim station that is part of a larger spiral binding apparatus. The trim heads include a pair of stationary crimping jaws which engage and hold the lead and trailing ends of the spiral coil while a rotating cutting jaw cuts the ends of the coil as they are held against a stationary cutting jaw. The rotating cutting jaw continues to rotate so that the ends of the coil are crimped inwardly and upwardly toward the book of sheets to provide offset ends which serve to inhibit unintentional withdrawal of the coil from the holes along the edge of the book. After the coil has been cut and crimped, the spiral bound book is indexed to a discharge station for discharge from the spiral binding machine.

17 Claims, 4 Drawing Sheets

FIG. 1
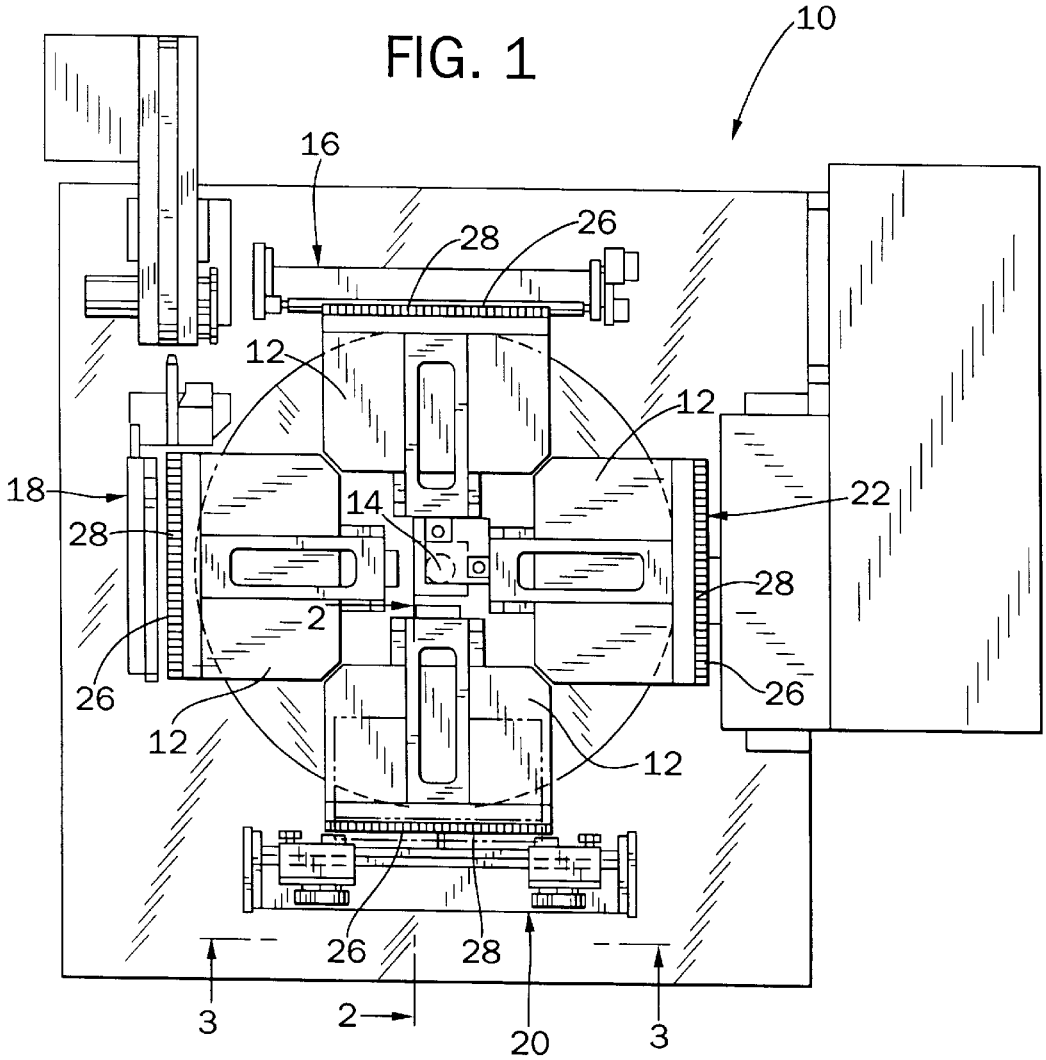
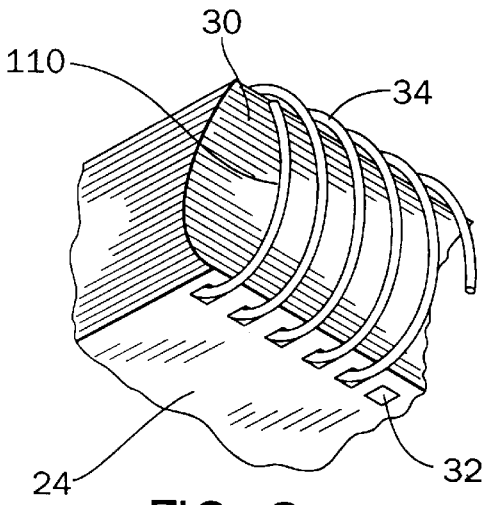
FIG. 8
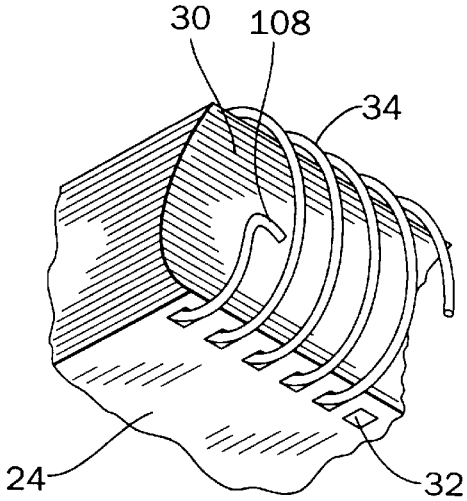
FIG. 10

APPARATUS AND METHOD FOR CUTTING AND CRIMPING A SPIRAL COIL

BACKGROUND OF THE INVENTION

The present invention pertains to an apparatus and related method for cutting and crimping the lead and trailing ends of a spiral coil binding a book of sheets.

Spiral binding coils have long been used to provide the edge bindings for books of paper sheets. Spiral coils may be metal or plastic. Books of sheets to be bound are prepunched with a series of equally spaced through holes along one edge of the book, and a spiral coil is typically inserted by rotating the coil on its axis and threading the same on a spiral path sequentially through the holes along the edge of the book. The lead and trailing ends of the spiral coil binding the book of sheets are then cut and crimped to inhibit unintentional withdrawal of the coil from the holes in the edge of the book. Spiral binding apparatus and methods have typically been fairly labor intensive and attempts to automate the binding process have been difficult due to wide variations in coils diameters, book thickness, coil materials and the like. Therefore, an automated spiral binding coil insertion device including a trim station for cutting and crimping the lead and trailing ends of the coil is desirable.

SUMMARY OF THE INVENTION

In accordance with the present invention, a spiral binding coil insertion device utilizes four station indexing which allows a book of sheets to be loaded and pre-positioned in a first station, indexed to an insertion station where the coil is inserted, further indexed to a trim station for coil cutting and crimping, and finally indexed to a discharge station. The four station book indexing arrangement permits four books to be processed simultaneously.

This particular invention describes in detail the trim station, and trim heads used for cutting and crimping the lead and trailing ends of a spiral coil binding a book of sheets. The trim station is part of the spiral binding coil insertion device described in our earlier pending patent application entitled "Spiral Coil Insertion Apparatus and Method", Ser. No. 09/050,613 incorporated herein by reference.

The trim station includes a generally horizontal book support, and a pair of trim heads which are adapted to receive and engage the lead and trailing ends of the spiral coil binding the book of sheets. The trim heads are mounted for lateral sliding adjustment on a slide bar that extends between a pair of vertical frame members of the trim station. The trim heads are brought into operable engagement with the lead and trailing ends of the coil by a linear actuator which operates to tilt the entire trim station on a trim tilt pivot to move the trim heads into and out of operable engagement with the ends of the spiral coil binding the book of sheets. The trim heads are locked in positions on the slide bar corresponding to the lead and trailing ends of the spiral coil by positioning screws extending through a slide bar mounting plate and engaging the top surface of the slide bar.

A pivotable holddown plate is provided for releasably holding the book on the book support for engagement of the trim heads with the ends of the coil. The pivotable holddown plate is adapted to rest on the upper face of the book in the trim station.

The trim heads each include a cutting and crimping mechanism and a rotary actuator for driving the mechanism. The cutting and crimping mechanism includes a pair of stationary crimping jaws attached to a trim head housing which capture and hold the ends of the coil, as the linear actuator is retracted to bring the trim heads into operative engagement with the coil ends. The cutting and crimping mechanism further includes a stationary cutting jaw also attached to the trim head housing and located opposite the pair of stationary crimping jaws, and a rotating cutting jaw attached to the end of a cylindrical shaft which is used for cutting and crimping the coil ends. The rotating cutting jaw is driven by the rotary actuator which drives a main drive pulley. A drive belt is connected between the main drive pulley and a trim head pulley. The trim head pulley is connected to the cylindrical shaft of the rotating cutting die.

The lead and trailing ends of the coil extend between the pair of stationary crimping jaws and in between the stationary cutting jaw and the rotating cutting jaw. The crimping and cutting jaws are mounted on the trim heads to lie in a plane disposed generally in the pitch angle of the coil. Once the coil ends are properly placed within the holding and cutting die, the rotary actuator begins driving the rotating cutting jaw in a counterclockwise direction to cut a portion of the coil end off between the knife edges of the stationary cutting jaw and the rotating cutting jaw. After the coil end is cut, the rotating cutting die continues to rotate in a counterclockwise direction crimping the remaining end of the coil upwardly and inwardly toward the book of sheets in order to create an offset end at the lead and trailing ends of the spiral coil. The offset ends inhibit unintentional withdrawal of the coil from the holes along the edge of the book.

Various other features, objects and advantages of the invention will be made apparent from the following drawings and detailed description.

BRIEF DESCRIPTION OF THE DRAWINGS

FIG. 1 is a top plan view of a spiral binding coil insertion machine including a coil trim station in accordance with the present invention.

FIG. 8 is a detailed perspective view of one end of the edge of a book bound with a spiral coil with the end of the coil uncut and uncrimped.

FIG. 10 is a detailed perspective view of one end of the edge of a book bound with a spiral coil with the end of the coil having been cut and crimped by the coil trim station.

DETAILED DESCRIPTION OF THE PREFERRED EMBODIMENT

Figure 2:
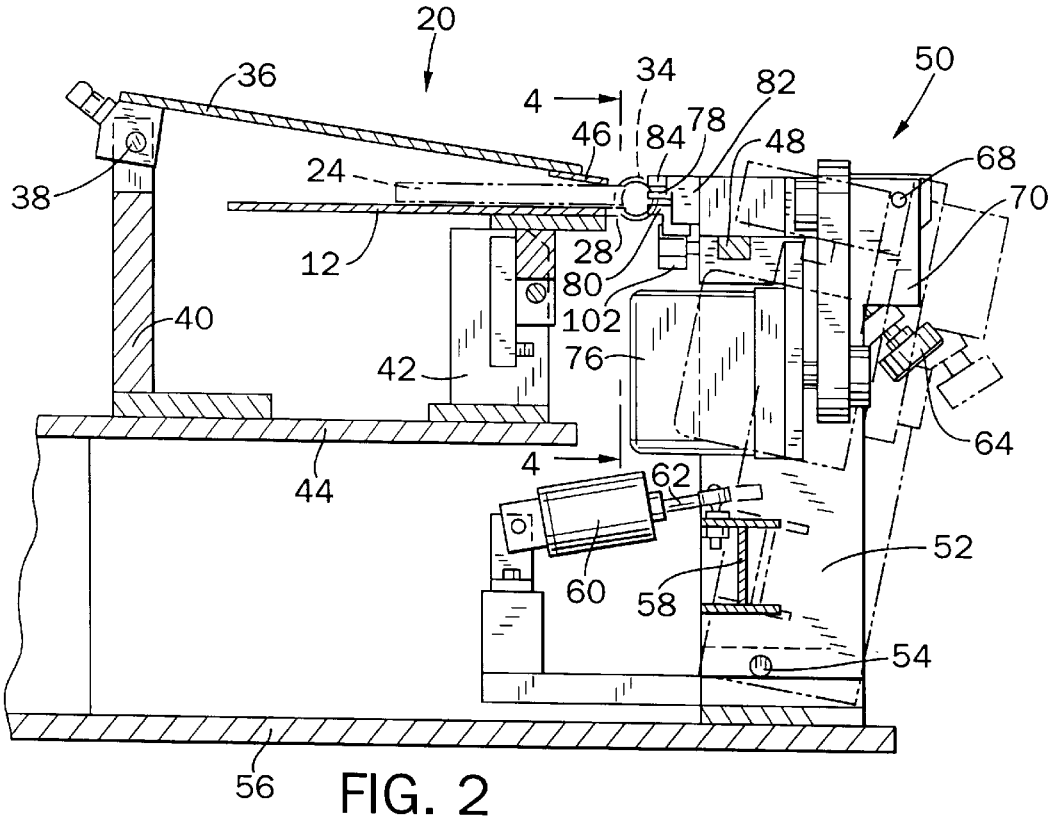
FIG. 2 is a vertical sectional view through the coil trim station taken on line 2—2 of FIG. 1.

As shown generally in the top plan view of FIG. 1, a coil insertion machine 10 includes four identical horizontal book support plates 12 mounted 90° apart and disposed to rotate together around the vertical axis of a central mounting post 14. Each of the support plates 12 is sequentially indexed through 90° of rotation to carry a book between a load station 16, a coil insertion station 18, a him station 20 and a discharge station 22. A book is being processed in each station 16, 18, 20 and 22 simultaneously, with all of the processing being accomplished fully automatically. This particular invention focuses on the details of the trim station 20.

As described in our above identified pending patent application, an operator standing in front of the load station 16 loads a book 24 on the coil insertion machine 10 by orienting the edge of the book down and extending horizontally on the support plate 12. Each of the book support plates 12 has a front edge 26 in the form of a replaceable comb 28. As best seen in FIGS. 8 and 10, the book 24 has one edge 30 which is provided with a series of equally spaced through holes 32 closely spaced from and on a line parallel to the edge 30. The holes may be round, square, or other shape as is well known in the art. When the book 24 is positioned on the support plate 12, the teeth of the comb 28 on the front edge of the support plate extend between the holes 32 in the edge of the book.

The book 24 is then indexed from the load station 16 to the coil insertion station 18. At the coil insertion station 18, a spiral coil drive mechanism is indexed upwardly from a lower inoperative position to its operative position to insert a spiral coil 34 in the through holes 32 of the book 24. The lead end of the coil 34 is threaded one convolution at a time into the through holes 32 in the book 24 until the coil has been inserted through all of the through holes in the book's edge 30. After the coil has been inserted in the through holes of the book, the coil drive mechanism is moved to its lower inoperative position and the book, book support plate and holddown plate rotate together from the insertion station 18 to the trim station 20.

Figure 3:
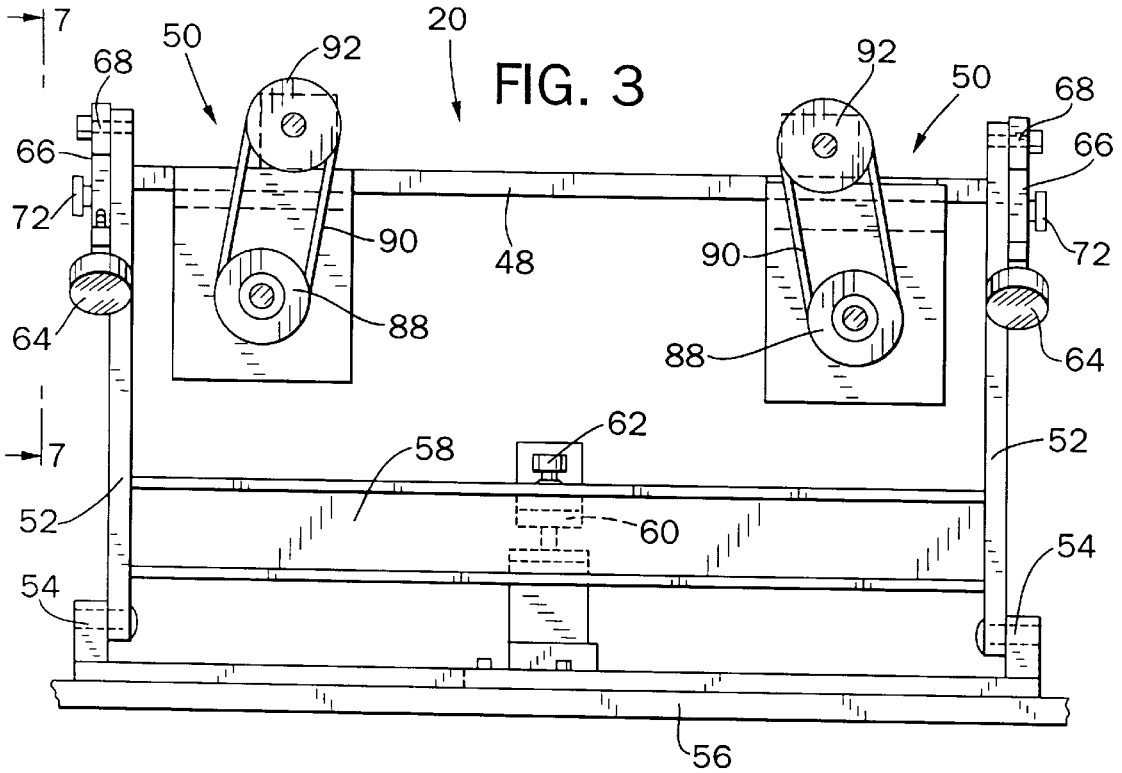
FIG. 3 is a front elevational view of the coil trim station taken on line 3—3 of FIG. 1.

Details of the trim station 20 are shown in FIGS. 2 and 3. FIG. 2 shows a sectional side view of the trim station 20 of the present invention. A spirally bound book 24 which is bound by a spiral coil 34 is supported on the trim station by a support plate 12. A holddown plate 36 is attached by a horizontal pivot joint 38 to a vertical holddown plate support 40. The vertical holddown plate support 40 and a vertical stand 42 are both supported on a rotatable platform 44. The rotatable platform 44 is mounted for rotation on the central mounting post 14. The holddown plate 36 includes a forward edge plate 46 which is pivoted downwardly into engagement with top of the book 24 just rearwardly of the spiral coil 34.

As seen in FIGS. 2 and 3, a pair of trim heads 50 are mounted for lateral sliding adjustment on a slide bar 48 which extends parallel to and spaced outwardly from the bound edge of the book 24 supported on the support plate 12. The trim heads 50 are moved to and locked into positions corresponding to the lead and trailing ends of the spiral coil 34. The convolutions of the coil remain positioned between the teeth of the comb 28 of the support plate 12 and serve to maintain the position of the book edge on the support plate. In this manner, the trim heads 50 are positioned to accurately engage the coil ends. The trim heads slide bar 48 extends between a pair of vertical frame members 52 which are connected at their lower ends by a trim tilt pivot 54 and a machine base 56. The vertical frame members 52 are interconnected with a cross member 58 to which the rod end 62 of a linear actuator 60 is attached. The trim station linear actuator 60, which may comprise an air cylinder, operates to tilt the entire trim station 20 on the trim tilt pivot 54 to move the trim station out of the way during rotational indexing of the support plate 12, the book 24 and the holddown plate 36 on the rotatable platform 44. The height of the trim heads 50 are adjustable to accommodate varying diameters of spiral coils by an adjustment screw 64 which acts on a pivot plate 66 about a pivot point 68 fastened to a trim station housing 70. The pivot plate 66 is locked in its proper position by a locking screw 72. Details of the trim head height adjustment are described in more detail below with reference to FIG. 7.

Figure 4:
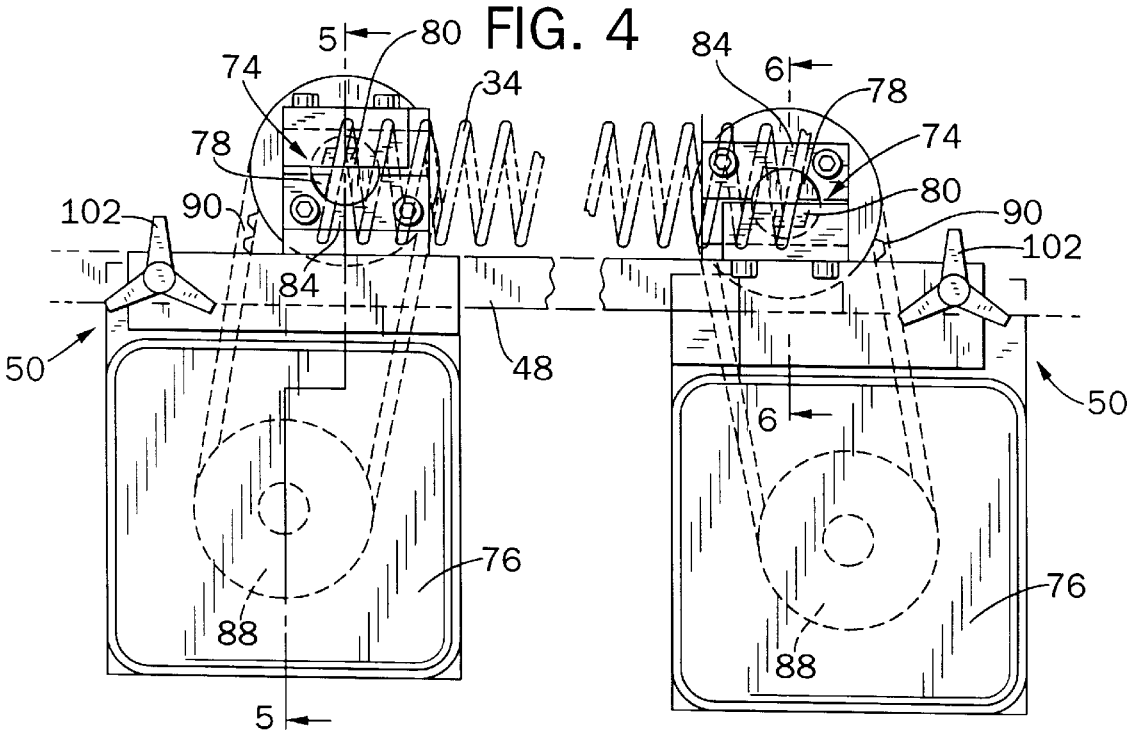
FIG. 4 is an enlarged front elevational view of a pair of trim heads of the coil trim station taken on line 4—4 of FIG. 2.

FIG. 4 shows an enlarged front elevational view of the pair of trim heads 50 mounted on the slide bar 48. The trim heads 50 each include a cutting and crimping mechanism 74 and a rotary actuator 76 for driving a rotating cutting jaw 78 within the cutting and crimping mechanism. Each of the two cutting and crimping mechanisms 74 include the same tooling but are rotated 180° from each other so that one mechanism is positioned to accept the downwardly extending lead end of the coil, while the other mechanism is positioned to accept the upwardly extending trailing end of the coil. The cutting and crimping mechanism further includes a pair of stationary crimping jaws 80 rigidly attached to a trim head housing 82 which capture and hold the lead and trailing ends of the coil as the linear actuator 60 is retracted to bring the trim heads 50 into operative engagement with the coil 34, a stationary cutting jaw 84 rigidly attached to the trim head housing 82 and located opposite the pair of stationary crimping jaws 80, and the rotating cutting jaw 78 fixedly attached to the end of a rotating cylindrical shaft 86 which cuts and crimps the coil ends.

The rotating cutting jaw 78 is rotated in a counterclockwise direction by the rotary actuator 76 which drives a main drive pulley 88. A toothed drive belt 90 is mounted on and between the main drive pulley 88 and a trim head pulley 92. The trim head pulley 92 is connected to the shaft 86 which has the rotating cutting jaw 78 attached to its far end opposite the end closest to the trim head pulley 92. The rotating shaft 86 is enclosed within the trim head housing 82, shown in FIGS. 5 and 6, which allow the shaft to freely rotate within the trim head housing. The rotating shaft 86 includes adjustable stops built-in to the cylindrical shaft to stop the rotating cutting jaw 78 after it has completed cutting and crimping the ends of the coil. Typically, the coil ends are crimped at an angle between 90° and 120° from their original uncrimped positions. For example, the ends of the coil are crimped at an angle of more than 90° to allow for some springback of the crimped ends.

The rotary actuator 76 rotates the rotating cutting jaw 78 in a counterclockwise direction to cut and crimp the lead and trailing ends of the spiral coil binding the book of sheets. After the rotating cutting jaw 78 has reached the adjustable stop on the rotating shaft 86 and completed cutting and crimping the ends of the coil, the rotary actuator 76 which consists of a bi-directional motor stops and reverses direction to rotate the rotating cutting jaw 78 in a clockwise direction back to its original cutting and crimping position.

Figure 5:
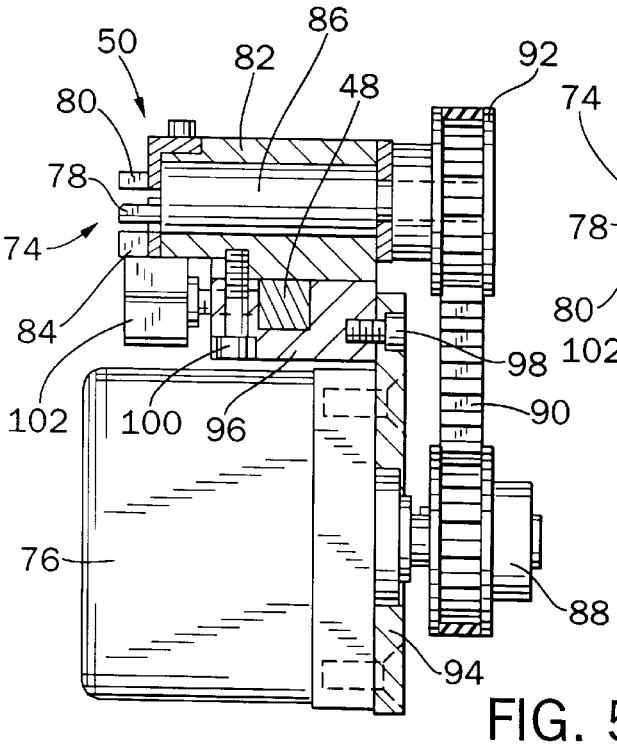
FIG. 5 is an enlarged sectional detail of one of the trim heads taken on line 5—5 of FIG. 4.
Figure 6:
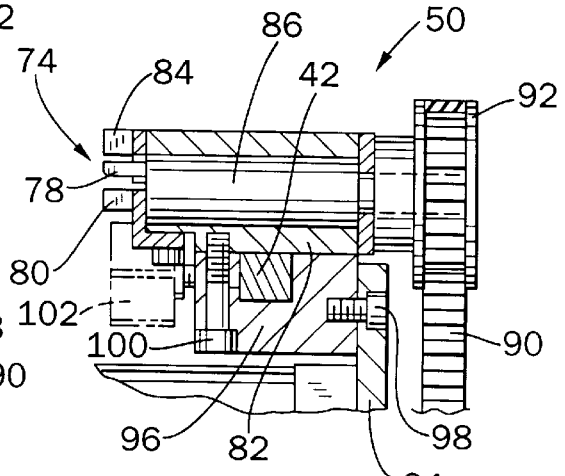
FIG. 6 is an enlarged sectional detail of the other trim head taken on line 6—6 of FIG. 4.

Referring particularly to the details of FIGS. 5 and 6, the rotary actuator 76 is attached to the trim head 50 by an actuator plate 94. The actuator plate 94 is bolted to the bottom of the rotary actuator and fastened to an actuator mount 96 by an actuator plate screw 98. The actuator mount 96 is fastened to the trim head housing 82 by an actuator mount screw 100. The actuator mount 96 is slidably mounted on the slide bar 48, and is locked in position by an adjustable trim head positioning screw 102.

As mentioned above, the two trim heads 50 are slidably mounted on the slide bar 48 and locked in positions corresponding to the lead and trailing ends of the spiral coil. The trim heads 50 are locked in these positions by securing the trim head positioning screws 102 extending through the actuator mounts 96 to the side surface of the slide bar 48. The trim head positioning screw 102 has a large knob preferably made of a hard durable plastic resin with a plurality of vanes extending therefrom for easy gripping and turning by a trim station operator. Once the trim heads 50 are in the proper position corresponding to the ends of the coil, the operator turns the knob of positioning screws 102 to lock the trim heads in place. However, detailed positioning of the cutting and crimping mechanism 74 may be necessary to accommodate varying diameters of spiral coils.

Figure 7:
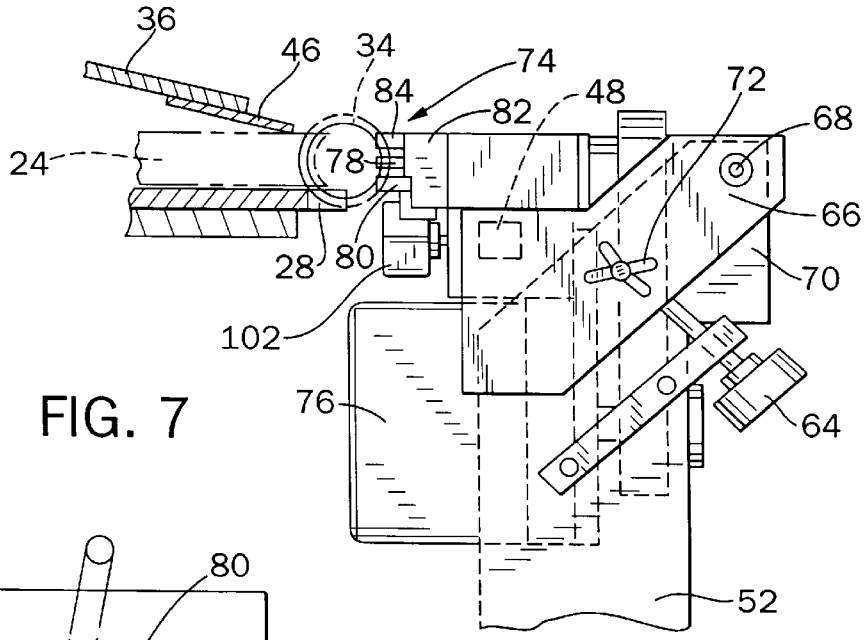
FIG. 7 is an enlarged side elevational detail of the coil trim station taken on line 7—7 of FIG. 3.

FIG. 7 shows an enlarged side elevational detail of the components of the trim station for adjusting the height of the cutting and crimping mechanism 74 on the coil ends. The height of the cutting and crimping mechanisms 74 are adjusted by an adjustment screw 64 that acts on a pivot plate 66 that pivots around a pivot point 68. The pivot plate 66 includes an elongated slot through the center of the plate for allowing the height of the cutting and crimping mechanisms to be adjusted. Extending through the slot in the pivot plate is a locking screw 72 for locking the position of the cutting and crimping mechanisms on the ends of the coil. The adjustment screw 64 is turned to pivot the pivot plate 66 around the pivot point 68 within the length of the elongated slot of the pivot plate. This allows for the cutting and crimping mechanism to accommodate varying diameters of spiral coils binding a book of sheets.

Figure 9A:
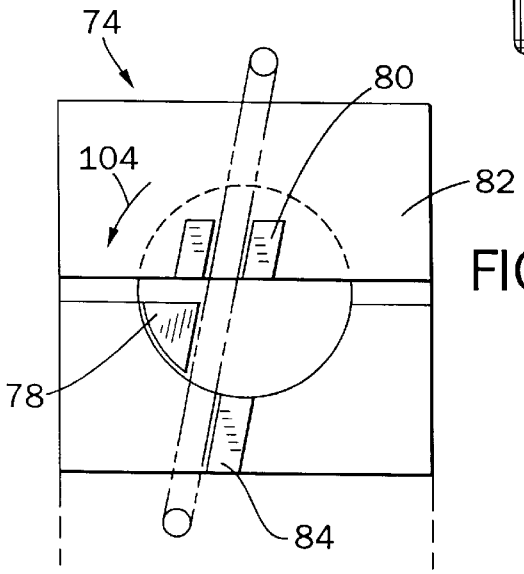
FIG. 9A is a front plan detail showing the end of the spiral coil inserted into one of the trim heads prior to cutting and crimping the end of the coil.
Figure 9B:
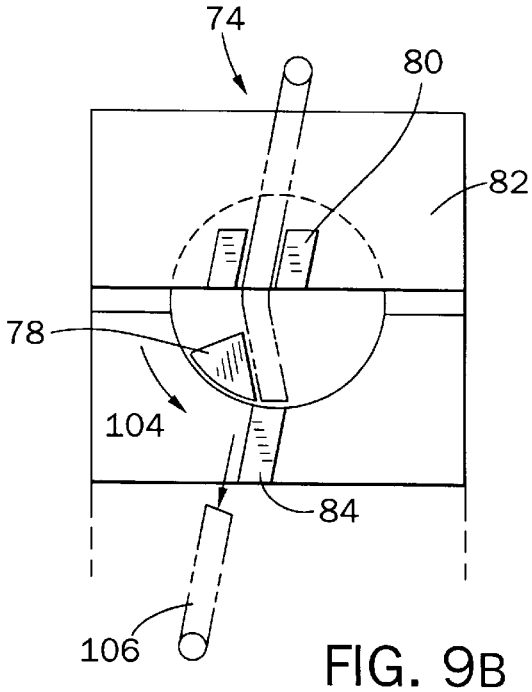
FIG. 9B is a front plan detail showing the end of the spiral coil being cut by the trim head of FIG. 9A.
Figure 9C:
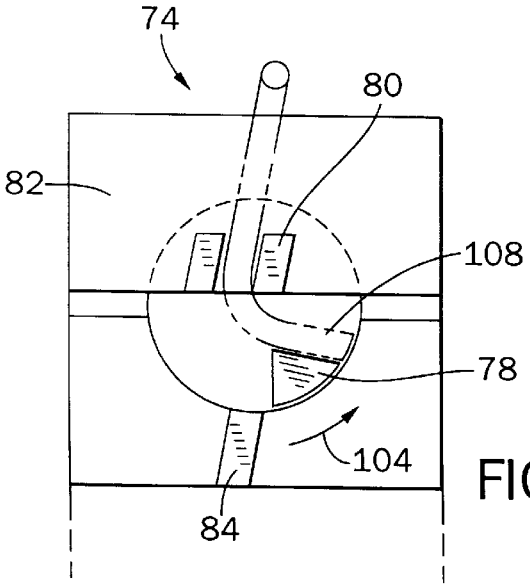
FIG. 9C is a front plan detail showing the cut spiral coil being crimped by the trim head of FIGS. 9A and 9B.

Operation of the cutting and crimping mechanism of the trim heads 50 are shown in FIGS. 9A, 9B and 9C. As can be seen in FIG. 9A, with the trim heads in their operative position, the lead or trailing end of the coil extends through the cutting and crimping mechanism 74. The coil end extends between the pair of stationary crimping jaws 80 and in between the stationary cutting jaw 84 and the rotating cutting jaw 78. The cutting and crimping jaws are all mounted at an angle to match the pitch angle of the coil. Once the coil end is properly positioned within the cutting and crimping jaws as shown in FIG. 9A, the rotary actuator 76 begins driving the rotating cutting jaw 78 in a counterclockwise direction, shown by arrow 104, to shear a portion 106 of the coil end off between the knife edges of the stationary cutting jaw 84 and the rotating cutting jaw 78, as shown in FIG. 9B. After the coil end has been cut off, the rotating cutting jaw 78 continues to rotate in a counterclockwise direction to crimp the remaining end of the coil upwardly and inwardly toward the book of sheets in order to create an offset end 108 as shown in FIG. 9C. Typically, the coil end is crimped at an angle between 90° and 120° from its original uncrimped position as shown in FIG. 9A. After the rotating cutting jaw 78 has reached the adjustable stop on the rotating shaft and completed cutting and crimping the end of the coil, the rotary actuator 76 stops and reverses direction to rotate the rotating cutting jaw in a clockwise direction back to its original cutting and crimping position as shown in FIG. 9A.

FIG. 8 shows a detailed perspective view of one end of the edge 30 of the book 24 bound with a spiral coil 34 after processing by the insertion station 18 and prior to processing by the trim station 20. At this point of the spiral coil binding process, the spiral coil end 110 is uncut and uncrimped.

FIG. 10 shows the same detailed perspective view of one end of the edge of the book bound with the coil after processing the spirally bound book through the trim station 20. The end of the spiral coil is cut and crimped by the cutting and crimping mechanisms of the trim heads resulting in an offset end 108 which serves to inhibit unintentional withdrawal of the coil 34 from the holes 32 in the edge of the book.

After the lead and trailing ends of the coil have been cut and crimped by the trim station 20, the linear actuator 60, which conveniently may comprise an air cylinder, is extended to tilt the trim station out of the way to allow the support plate 12 and spirally bound book 24 to be rotationally indexed to the discharge station 22.

In the discharge station 22, the support plate 12 is tilted by a linear actuator into coplanar alignment with a stationary side plate into which the spirally bound book slides by gravity. Retraction of the linear actuator allows the now empty support plate 12 to pivot back to its operative horizontal position for rotational indexing back to the load station 16, where a new book of sheets is positioned for automatic spiral binding.

Various alternatives and modifications of the invention are contemplated as being within the scope of the following claims particularly pointing out and distinctly claiming the subject matter regarded as the invention.

We claim:

1. An apparatus for cutting and crimping the lead and trailing ends of a spiral binding coil inserted into the edge of a book of sheets, which edge has been provided with a series of equally spaced through holes on a line parallel to the edge, said apparatus comprising:

a trim station having a pair of trim heads attached thereto;

a first cutting and crimping tool mounted for rotary movement on one of said pair of trim heads, wherein said first cutting and crimping tool rotates to cut one end of the coil and continues rotating to crimp the lead end of said coil upwardly toward the book of sheets;

a second cutting and crimping tool mounted for rotary movement on the other of said pair of trim heads, wherein said second cutting and crimping tool rotates to cut the other end of the coil and continues rotating to crimp the trailing end of said coil downwardly toward the book of sheets; and a rotary actuator for driving said cutting and crimping tools.

2. The apparatus of claim 1 further comprising a trim head housing extending from each of said trim heads toward the coil and having a cylindrical rotating shaft disposed therein with said rotating cutting and crimping tool mounted to an end of the shaft closest to the coil.

3. The apparatus of claim 2 further comprising a pair of stationary crimping jaws mounted to said trim head housing for engaging the lead and trailing ends of the coil and a stationary cutting jaw mounted to said trim head housing opposite said stationary crimping jaws.

4. The apparatus as set forth in claim 1 wherein said pair of trim heads are mounted for lateral sliding adjustment on a slide bar extending between a pair of vertical frame members of the trim station.

5. The apparatus as set forth in claim 4 further comprising means for locking said pair of trim heads in positions corresponding to the lead and trailing ends of the coil.

6. The apparatus as set forth in claim 1 wherein the trim station further comprises a linear actuator operating to move the trim station and corresponding trim heads between a first inoperable position and a second operable position where said trim heads are in engagement with the ends of the coil.

7. The apparatus as set forth in claim 3 wherein the first pair of stationary crimping jaws are mounted on said trim head housing above the rotating cutting and crimping tool to engage a downwardly extending lead end of the coil, and the second pair of stationary crimping jaws being mounted to the trim head housing below the rotating cutting and crimping tool to engage an upwardly extending trailing end of the coil.

8. The apparatus as set forth in claim 3 wherein the pair of stationary crimping jaws, the stationary cutting jaw and the rotating cutting jaw are all positioned at an angle equal to the pitch angle of the coil.

9. The apparatus as set forth in claim 1 further comprising means for adjusting the height of said pair of trim heads to accommodate varying diameters of spiral coils binding the book of sheets.

10. The apparatus as set forth in claim 1 wherein the rotary actuator comprises a bi-directional motor for rotating the cutting and crimping tool in a counterclockwise direction to cut and crimp the lead and trailing ends of the coil, and reversing direction to rotate the cutting and crimping tool in a clockwise direction back to its original cutting and crimping position.

11. A method for cutting and crimping the lead and trailing ends of a spiral binding coil inserted into the edge of a book of sheets, which edge has been provided with a series of equally spaced through-holes on a line parallel to the edge, said method comprising the steps of:

(a) supporting the spirally bound book horizontally on a support;

(b) engaging the lead and trailing ends of the coil with a pair of trim heads;

(c) positioning the lead and trailing ends of the coil in the trim heads between a pair of stationary crimping jaws, and between a rotating cutting and crimping tool and a stationary cutting jaw;

(d) cutting the lead and trailing ends of the coil by rotating the rotating cutting and crimping tool toward the stationary cutting jaw to cut off a portion of the ends between the knife edges of the stationary cutting jaw and the rotating cutting jaw; and (e) crimping the remaining ends of the coil by continuing to rotate the rotating cutting and crimping tool after the ends of the coil have been cut off.

12. The method as set forth in claim 11 wherein the engaging step further comprises moving the trim heads from a first inoperable position to a second operable position where the trim heads are in engagement with the ends of the coil.

13. The method as set forth in claim 11 wherein the positioning step further comprises adjusting the height of the trim heads to accommodate varying diameters of coils.

14. The method as set forth in claim 11 wherein the step of cutting the coil ends further comprises rotating the rotating cutting and crimping tool in a counterclockwise direction by a rotary actuator.

15. The method as set forth in claim 11 wherein the step of crimping the coil ends further comprises continuing to rotate the rotating cutting and crimping tool in a counterclockwise direction to crimp the remaining ends of the coil upwardly and inwardly toward the book of sheets to inhibit unintentional withdrawal of the coil from the holes along the edge of the book.

16. The method as set forth in claim 11 further comprising the step of reversing the rotation of the rotating cutting and crimping tool after cutting and crimping the ends of the coil to return the rotating cutting and crimping tool to its original cutting and crimping position.

17. The method as set forth in claim 16 wherein the step of reversing rotation of the rotating cutting and crimping tool further comprises rotating the rotating cutting and crimping tool in a clockwise direction.

* * * * *